US007905824B2

(12) United States Patent
Schneider et al.

(10) Patent No.: US 7,905,824 B2
(45) Date of Patent: Mar. 15, 2011

(54) IMPLANTABLE HEARING AID TRANSDUCER WITH ADVANCEABLE ACTUATOR TO FACILIATE COUPLING WITH THE AUDITORY SYSTEM

(75) Inventors: Robert Edwin Schneider, Erie, CO (US); Scott Allan Miller, III, Lafayette, CO (US); James Frank Kasic, II, Boulder, CO (US)

(73) Assignee: Otologics, LLC, Boulder, CO (US)

( * ) Notice: Subject to any disclaimer, the term of this patent is extended or adjusted under 35 U.S.C. 154(b) by 721 days.

(21) Appl. No.: 11/868,842

(22) Filed: Oct. 8, 2007

(65) Prior Publication Data

US 2008/0249351 A1 Oct. 9, 2008

Related U.S. Application Data

(62) Division of application No. 10/351,699, filed on Jan. 27, 2003, now Pat. No. 7,278,963.

(51) Int. Cl.
*H04R 25/00* (2006.01)

(52) U.S. Cl. ..... 600/25

(58) Field of Classification Search ..... 600/25; 607/55–57; 181/128–137; 381/312–331
See application file for complete search history.

(56) References Cited

U.S. PATENT DOCUMENTS

| | | | | |
|---|---|---|---|---|
| 2,164,121 | A | | 6/1939 | Pescador |
| 3,902,084 | A | | 8/1975 | May, Jr. |
| 3,902,085 | A | | 8/1975 | Bizzigotti |
| 4,150,262 | A | | 4/1979 | Ono |
| 4,498,461 | A | | 2/1985 | Hakansson |
| 5,085,628 | A | | 2/1992 | Engebretson et al. |
| 5,277,694 | A | | 1/1994 | Leysieffer et al. |
| 5,282,858 | A | | 2/1994 | Bisch et al. |
| 5,702,342 | A | * | 12/1997 | Metzler et al. ..... 600/25 |
| 5,788,711 | A | * | 8/1998 | Lehner et al. ..... 606/130 |
| 5,954,628 | A | | 9/1999 | Kennedy |
| 5,993,376 | A | | 11/1999 | Kennedy |
| 6,162,169 | A | | 12/2000 | Leysieffer |
| 6,190,306 | B1 | | 2/2001 | Kennedy |
| 6,251,062 | B1 | | 6/2001 | Leysieffer |
| 6,315,710 | B1 | | 11/2001 | Bushek et al. |
| 6,398,717 | B1 | | 6/2002 | Leysieffer et al. |
| 6,482,144 | B1 | | 11/2002 | Muller |
| 6,537,201 | B1 | | 3/2003 | Kasic et al. |
| 6,592,512 | B2 | | 7/2003 | Stockert et al. |
| 6,620,093 | B2 | | 9/2003 | Waldmann et al. |
| 6,620,110 | B2 | * | 9/2003 | Schmid ..... 600/559 |
| 6,663,575 | B2 | | 12/2003 | Leysieffer |
| 6,676,592 | B2 | | 1/2004 | Ball et al. |

(Continued)

FOREIGN PATENT DOCUMENTS

WO 0150815 7/2001

*Primary Examiner* — Samuel G Gilbert
(74) *Attorney, Agent, or Firm* — Marsh Fischmann & Breyfogle LLP

(57) ABSTRACT

A hearing aid transducer that includes an actuator advanceable relative to the transducer to couple with a middle ear component. In one aspect of the invention, the actuator is a separate structure from the transducer that is insertable into an aperture defined between a first and second end of the transducer. This permits separate connection of the actuator to the middle ear component and the transducer to improve coupling of the transducer to the middle ear component, e.g., minimizing loads on the middle ear component.

20 Claims, 8 Drawing Sheets

U.S. PATENT DOCUMENTS

| | | | |
|---|---|---|---|
| 6,945,999 | B2 | 9/2005 | Schneider |
| 2001/0031908 | A1 | 10/2001 | Buschek et al. |
| 2002/0019668 | A1 | 2/2002 | Stockert et al. |
| 2002/0051550 | A1 | 5/2002 | Leysieffer |
| 2003/0229262 | A1 | 12/2003 | Easter et al. |
| 2007/0142697 | A1 | 6/2007 | Schneider |

* cited by examiner

IMPLANTABLE HEARING AID TRANSDUCER WITH ADVANCEABLE ACTUATOR TO FACILIATE COUPLING WITH THE AUDITORY SYSTEM

RELATED APPLICATIONS

This application claims priority as a Divisional Application to U.S. patent application Ser. No. 10/351,699, filed Jan. 27, 2003 now U.S. Pat. No. 7,278,963, entitled "IMPLANTABLE HEARING AID TRANSDUCER WITH ADVANCEABLE ACTUATOR TO FACILIATE COUPLING WITH THE AUDITORY SYSTEM".

BACKGROUND OF THE INVENTION

Implantable hearing aids entail the subcutaneous positioning of some or all of various hearing augmentation componentry on or within a patient's skull, typically at locations proximate the mastoid process. Implantable hearing aids may be generally divided into two classes, semi-implantable and fully implantable. In a semi-implantable hearing aid, components such as a microphone, signal processor, and transmitter may be externally located to receive, process, and inductively transmit a processed audio signal to implanted components such as a receiver and transducer. In a fully-implantable hearing aid, typically all of the components, e.g., the microphone, signal processor, and transducer, are located subcutaneously. In either arrangement, a processed audio signal is provided to a transducer to stimulate a component of the auditory system By way of example, one type of implantable transducer includes an electromechanical transducer having a magnetic coil that drives a vibratory actuator. The actuator is positioned to mechanically stimulate the ossicles via physical engagement. (See e.g., U.S. Pat. No. 5,702,342). In this regard, one or more bones of the ossicles are made to mechanically vibrate, causing the vibration to stimulate the cochlea through its natural input, the so-called oval window. An example of this transducer is included in the MET™ hearing aid of Otologics, LLC, in which a small electromechanical transducer is used to vibrate the incus (the 2nd of the 3 bones forming the ossicles), and thence produce the perception of sound. In this case, the vibratory actuator is coupled to the ossicles during mounting and positioning of the transducer within the patient. In one example, such coupling may occur via a small aperture formed in the incus bone.

As will be appreciated, coupling with the ossicles poses numerous challenges. For instance, during positioning of the transducer, it is often difficult for an audiologist or surgeon to determine the extent of the coupling. In other words, how well the actuator is attached to the ossicles. Additionally, due to the size of the transducer relative to the ossicles, it is difficult to determine if loading exists between the ossicles and transducer. In this regard, precise control of the engagement between the actuator of the transducer and the ossicles is of critical importance as the axial vibrations can only be effectively communicated when an appropriate interface or load condition exists between the transducer and the ossicles. Overloading or biasing of the actuator can result in damage or degraded performance of the biological aspect (movement of the ossicles) as well as degraded performance of the mechanical aspect (movement of the vibratory member). Additionally, an underloaded transducer, e.g., where the actuator is not fully connected to the ossicles, may result in reduced performance of the transducer.

Another difficulty with such coupling is that in some cases patients can experience a "drop-off" in hearing function after implantation. Such a drop off may be caused by changes in the physical engagement of the actuator, e.g., due to things such as tissue growth, or may be caused by a malfunction of the transducer or other componentry. After implantation, however, it is difficult to readily assess the performance and/or adjust an implanted transducer and interconnected componentry. For example, in the event of a "drop-off" in hearing function after implantation, it is difficult to determine the cause, e.g., over/under loading of the interface due to tissue growth or some other problem with the hearing aid, without invasive and potentially unnecessary surgery. In addition, once coupled for an extended period, the maintenance and/or replacement with a next generation transducer may be difficult.

SUMMARY OF THE INVENTION

In view of the foregoing, a primary object of the present invention is to simplify and improve implantation procedures for implantable hearing aid transducers. Another object of the present invention is to improve coupling of implantable transducers with a middle ear component, such as the ossicles. Another object of the present invention is to provide a means for achieving a proper interface, e.g., a low mechanical bias or no-load interface, between an implanted hearing aid transducer and a component of the auditory system. Another object of the present invention is to provide a hearing aid transducer with the ability to compensate in situ for undesirable interfaces, e.g., over or under loaded with respect to the component of the auditory system. In the context of the present invention, "in situ," refers to in its proper position, e.g., in the context of the present transducer, as implanted in a patient and coupled to a middle ear component. A related object of the present invention is to provide an implantable hearing aid transducer with the ability to self compensate for undesirable interfaces both during implantation and subsequent to implantation. Another object of the present invention is to provide a means for removal, subsequent to implantation, of an implantable hearing aid transducer, e.g., for an upgrade and/or repair.

In relation to a transducer according to the present invention, each of the various aspects discussed in more detail below may include a transducer body preferably constructed from a biocompatible material that is implantable with in a patient. The transducer may also generally include an actuator associated with the transducer body to stimulate a component of the middle ear. The transducer may also include a driver to drive the actuator in response to transducer drive signals. The driver may be of any suitable design to drive the actuator and stimulate an associated middle ear component to produce or enhance the sensation of sound for a patient. For instance, some examples of the driver may include without limitation, an electrical, piezoelectric, electromechanical, and/or electromagnetic driver.

One or more of the above objectives and additional advantages may be realized by a first aspect of the present invention, which provides an implantable hearing aid transducer having an advanceable actuator. The transducer includes a transducer body having an aperture extending through at least a first side thereof, an actuator, and a driver to drive the actuator. According to this characterization, the actuator is advanceable through the aperture to couple with a middle ear component, e.g., the ossicles. It should be noted that in the context of the present invention, the coupling with the middle ear component may include a physical attachment or an adjacent positioning of the actuator relative the middle ear component.

Various refinements exist of the features noted in relation to the subject first aspect of the present invention. Further features may also be incorporated in the subject first aspect as well. These refinements and additional features may exist individually or in any combination. For instance, the aperture may also extend through a second side of the transducer body. In another instance, the actuator may be a separate structure from the transducer and be separately connectable to both the middle ear component and the transducer. In this regard, the transducer may also include a coupler for connecting the actuator to the transducer, e.g., within the aperture. In one example according to the present aspect, the coupler may be an adhesive, clamp or other means for connecting the actuator to the transducer. In another example according to the present aspect, the coupler may be selectively activatable between a coupled and uncoupled state to permit both connection of the actuator to the transducer and disconnection of the actuator from the transducer. For instance, the coupler may be constructed from a shape memory alloy activatable in response to a stimulus to connect and disconnect the actuator. In another example according to the present aspect, the coupler may be a material that is reshapeable in situ to permit compensating movements of the actuator to minimize loading between the middle ear component and transducer, e.g., such as may be caused by natural movement of the ossicles due to pressure changes, swallowing, etc. In this case, it is desirable that the reshapeable material be viscous enough at body temperature to permit gradual displacement of the actuator relative to the transducer but resistive to sudden movements to permit stimulation of the middle ear component in response to transducer drive signals.

In one example of an actuator according to the present aspect, the actuator may comprise a unitary elongated member that is both insertable into the aperture of the transducer body and advanceable relative thereto to couple with the middle ear component. In another example of an actuator according to the present aspect, the actuator may include first and second actuator members. In this case, one of the members may be connectable to the middle ear component, while the other member is advanceable relative to the transducer to couple with the member connected to the middle ear component. In this case, the actuator members may be coupled in any suitable manner whereby the coupled actuator members are sufficiently rigid for stimulation, e.g., through vibration of the middle ear component. It may be desirable, however, to provide a detachable coupler between the first and second actuator members, such as provided by the above described shape memory alloy. This provides the advantage of being able to uncouple the actuator members for removal of the transducer without disturbing the interface between the first actuator and the ossicles.

The actuator may be constructed from any material of sufficient rigidity for transmission of vibrations to the middle ear component. Some examples of the actuator include a wire, tube, pin etc., preferably formed from a biocompatible material. In this regard, it may be desirable that the length of the actuator be sufficiently longer than necessary for coupling with the middle ear component and transducer. In this case the coupling process may be facilitated, as the excess length is easier to work with during coupling and may be trimmed subsequent to connection to the transducer.

One or more of the above objectives and additional advantages may also be realized by a second aspect of the present invention, which provides an implantable hearing aid transducer having an actuator advanceable through a tube. In this case, the transducer includes a transducer body having an aperture extending through at least a first side thereof defined by the tube. According to this characterization, the actuator is advanceable through the tube, which in turn is connected to the transducer by a bellows member. Specifically, the bellows member may be connected between the first side of the transducer body and a first end of the tube.

Various refinements exist of the features noted in relation to the subject second aspect of the present invention. Further features may also be incorporated in the subject second aspect as well. These refinements and additional features may exist individually or in any combination. For instance, as with the above aspect the aperture may also extend through a second side of the transducer body. In this case, a second bellows member may be utilized to connect a second end of the tube to a second side of the transducer body to movably connect the tube to the transducer body. In this regard, the actuator may be a separate structure from the transducer that is separately connectable to both the middle ear component and the transducer, e.g., within the tube. According to this characterization, a driver of the transducer may be connected to the tube such that both the tube and the actuator are movable by the driver during stimulation of the middle ear component.

It will be appreciated that the transducer according to this aspect may be configured with either of the above-described actuators, e.g., a unitary actuator or two-piece actuator. Further, in this regard, the actuator may also be connected to the tube according to any of the above connection techniques.

One or more of the above objectives and additional advantages may also be realized by a third aspect of the present invention, which provides a method for implanting a hearing aid transducer within a patient. The method includes the steps of mounting/implanting a transducer body subcutaneously within the patient and aligning an aperture in at least a first side of the transducer body with a desired interface point on a middle ear component. According to this aspect, the transducer body may be initially loosely mounted within the patient to facilitate the step of aligning the transducer body with the desired interface on the middle ear component. In this regard, the method may further include securing the transducer body in the aligned position and advancing an actuator through the aperture toward the middle ear component for coupling to the same.

Various refinements exist of the features noted in relation to the subject third aspect of the present invention. Further features may also be incorporated in the subject third aspect as well. These refinements and additional features may exist individually or in any combination. For instance, the aligning step may include axially and laterally aligning the aperture with the desired interface. In this case, the method may further include the use of a guide, such as a laser sight to achieve a more precise alignment of the aperture with the desired interface.

Subsequent to mounting and aligning the transducer body, the method may further include using the aperture to form an interface on the middle ear component for the coupling of the actuator. According to this characterization, the method may further include inserting the actuator into the aperture prior to the advancing step, but subsequent to formation of the interface. Thereafter, the method may include coupling a distal end of the actuator to the middle ear component. It should be noted that according to the present method, the actuator may be a unitary actuator in which case the method may further include the step of coupling the other end of the actuator to the transducer. Alternatively, the actuator may be a two-piece actuator, in which case the method may include the steps of coupling a first actuator member to the middle ear component, advancing a second actuator member through the aperture, and connecting the first and second actuator members. In either case, the actuator may be detachably connected to the transducer to facilitate removal of the transducer without disturbing the coupling with the middle ear component.

One or more of the above objectives and additional advantages may also be realized by a fourth aspect of the present invention, which provides a method for implanting a hearing aid transducer within a patient. The method includes the steps of mounting/implanting a transducer body subcutaneously within the patient and aligning an aperture extending through a first and second side of the transducer body with a desired interface point on a middle ear component. As with the above aspect, the transducer body may be initially loosely mounted within the patient to facilitate the step of aligning the transducer body with the desired interface on the middle ear component. In this regard, the method further includes securing the transducer body in the aligned position and inserting an actuator through the aperture to couple with a middle ear component. Various refinements exist of the features noted in relation to the subject fourth aspect of the present invention. Further features may also be incorporated in the subject fourth aspect as well. These refinements and additional features may exist individually or in any combination.

One or more of the above objectives and additional advantages may also be realized by a fifth aspect of the present invention, which provides a method for operating an implantable transducer. The method includes the steps of receiving in a transducer, transducer drive signals, and processing the transducer drive signals to vibrate a tube movably connected to the transducer. In this regard, the method further includes, vibrating an actuator with the tube to stimulate a middle ear component. Various refinements exist of the features noted in relation to the subject fifth aspect of the present invention. Further features may also be incorporated in the subject fifth aspect as well. These refinements and additional features may exist individually or in any combination.

One or more of the above objectives and additional advantages may also be realized by a sixth aspect of the present invention, which provides a hearing aid that includes an acoustic signal receiver, signal processor, and implantable transducer. The acoustic signal receiver is operable to receive acoustic sound and generate acoustic response signals for the signal processor. The signal processor, in turn, is operable to process the acoustic response signals to generate transducer drive signals. The transducer includes a transducer body and actuator member that is advanceable relative to the transducer body. In this regard, the transducer may be any one of the above-described transducers, e.g., having a unitary or multiple actuator members.

Various refinements exist of the features noted in relation to the subject sixth aspect of the present invention. Further features may also be incorporated in the subject sixth aspect as well. These refinements and additional features may exist individually or in any combination. For instance, the present hearing aid may be a fully or semi-implantable hearing aid. In semi-implantable hearing aid applications, the acoustic sounds may be inductively coupled to the implanted transducer via an external transmitter and implanted receiver. In fully implantable applications, the acoustic sounds may be received by an implanted acoustic signal receiver e.g., an omni-directional microphone, and provided to an implanted signal processor for generation of the transducer drive signals. Additional aspects, advantages and applications of the present invention will be apparent to those skilled in the art upon consideration of the following.

DETAILED DESCRIPTION

Reference will now be made to the accompanying drawings, which at least assist in illustrating the various pertinent features of the present invention. In this regard, the following description is presented for purposes of illustration and description and is not intended to limit the invention to the form disclosed herein. Consequently, variations and modifications commensurate with the following teachings, and skill and knowledge of the relevant art, are within the scope of the present invention. The embodiments described herein are further intended to explain the best modes known of practicing the invention and to enable others skilled in the art to utilize the invention in such, or other embodiments and with various modifications required by the particular application(s) or use(s) of the present invention.

Figure 1:
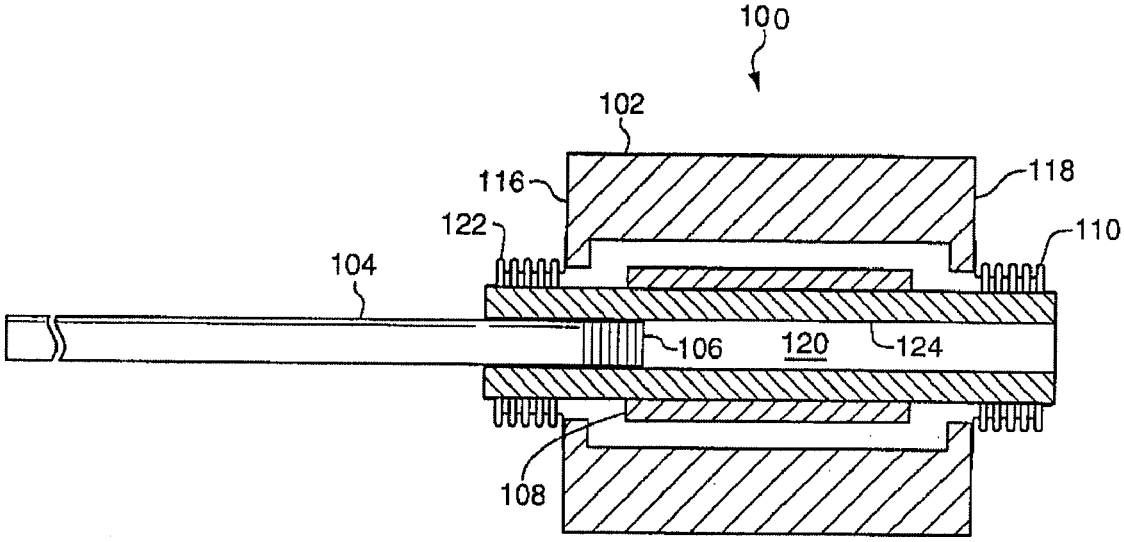
FIG. 1 illustrates a schematic view of a transducer for a semi-implantable or fully implantable hearing aid device.

FIG. 1 illustrates a schematic view of a transducer 100 according to the principles of the present invention. The transducer 100 may be employed with either a fully implantable hearing aid, wherein all of the components are located subcutaneously, or in conjunction with a semi-implantable hearing aid, wherein at least a portion of the hearing aid components, e.g., the microphone, are externally located relative to a patient.

The transducer 100 includes a transducer body 102, an actuator 104, and a driver 108. The transducer 100 may also include other conventional components such as transducer electronics etc., not shown on FIG. 1 for clarity. The transducer body 102 is an implantable housing, preferably biocompatible and having a substantially central aperture 120 defined between a first end 116 and a second end 118. The transducer body 102 may be constructed in various shapes, e.g., cylindrical or rectangular, as a matter of design choice. The transducer body 102 is mountable subcutaneously within the patient's mastoid process (e.g., via a hole drilled through the skull), in proximity to a desired coupling point with the auditory system, e.g., the ossicles.

The transducer 100 further includes a cylindrical tube 124 that defines the aperture 120 between the ends 116 and 118. As will be further described below, the driver 108 is connected to the tube 124, which in turn is movably connected to the transducer body 102. This permits the driver 108 to axially vibrate the actuator 104 using the tube 124. In this regard, the tube 124 is appropriately sized to receive the actuator 104 therein during implantation of the transducer 100. Operationally, the actuator 104 is insertable through the aperture 120 such that a distal end 106 is positioned within the middle ear to stimulate the ossicles through selectively induced axial vibrations of the actuator 104. These vibrations are in turn communicated to one of the bones of the ossicles, such as the incus bone, to yield enhanced hearing.

According to one embodiment of the present transducer 100, the actuator 104 may be an elongated member that is separately connectable to the transducer body 102 and to the ossicles of the patient. According to this characterization, the actuator 104 is designed for insertion through the tube 124 where it may be attached to the ossicles of the patient prior to connection to the transducer body 102. The actuator 104 may then be supportably connected within the tube 124 such that a minimal load is imposed on the ossicles during or subsequent to implantation by the transducer 100. Specifically, the aperture 120 of the transducer 100 may be precisely aligned with the actuator 104 during implantation, such that when the actuator 104 and transducer 100 are coupled, any load imposed on the ossicles, such as by the weight of the actuator 104, is substantially removed through support provided by the transducer 100 when the actuator 104 is coupled thereto. As will be further discussed below, the supportable connection between the actuator 104 and the transducer body 102 may be made in any suitable manner that permits transmission of axial vibrations from the transducer 100 to the ossicles of the patient. Some examples of connection alternatives include without limitation, adhesives, mechanical couplers, shape memory alloys, and materials that are reshapeable in situ.

To maintain isolation of the internal components of the transducer 100, bellows 110 and 122 may be utilized to connect each end of the tube 124 to the transducer body 102. The bellows, 110 and 122, are hermetically interconnected to each end of the tube 124 and the transducer body 102 such that they form a seal with the tube 124 to isolate the internal components of the transducer 100 from the introduction of bodily fluids. As will become apparent from the following description, however, the interior of the tube 124 does not include sensitive transducer components and therefore may or may not be completely sealed as a matter of design choice.

The bellows, 110 and 122, also permit a movable connection of the tube 124 relative to the transducer body 102. Alternatively, as will be further described below, other means may be utilized to provide the movable connection and may or may not provide isolation of the internal components of the transducer 100. In this regard, the bellows, 110 and 122, each comprise a plurality of undulations that permit the bellows, 110 and 122, to axially respond in an accordion-like fashion to axial vibrations of the tube 124 by the driver 108. In this manner, when the actuator 104 is connected within the tube 124, the driver 108 may induce vibration of the connected tube 124 and actuator 104 to stimulate the ossicles of the patient. The driver 108 may be any device operational to process transducer drive signals to produce axial vibration of the tube 124, and in turn, the actuator 104. Some examples, of the driver 108 include without limitation, a piezoelectric driver, and an electromagnetic driver.

Advantageously, the separate connection of the actuator 104 to the auditory system and the transducer 100 minimizes loading on the auditory system during implantation of the transducer 100. Specifically, the separate attachment of the actuator 104 to the transducer 100 provides the advantage of allowing an audiologist or surgeon to implant the transducer body 102 within the patient such that the aperture 120 is aligned with a desired interface point on the ossicles. Subsequent to implantation and alignment of the transducer body 102, the actuator 104 may be separately inserted through the aligned aperture 120 for connection with the ossicles. According to this characterization, the only load imposed on the ossicles is the load imposed by the weight of the actuator 104, which is negligible compared to that of the transducer 100 as a whole. Furthermore, because the weight of the actuator 104 is relatively negligible, proper coupling with the ossicles is facilitated as an audiologist or surgeon is able to better sense when a proper couple is achieved. Finally, since the weight of the actuator 104 is relatively negligible, if a load is imposed on the ossicles during connection of the actuator 104, the load is released when pressure applied during the connection is released, as the ossicles is able to move the connected actuator 104 to its equilibrium position prior to connection of the actuator 104 to the transducer 100, e.g., within the tube 124.

Advantageously, the separate connection of the actuator 104 also facilitates alignment of the transducer 100 with the desired component of the auditory system, e.g., the incus bone. For instance, if after connection of the actuator 104 to the ossicles, it is noticed that the alignment is not perfect, the transducer body 102 may be loosened from its secure position and further aligned as necessary with the actuator 104. In this case, the actuator 104 may serve as a guide for the finite alignment of the transducer body 102 with the ossicles. Furthermore, the aperture 120 also provides additional advantages during preparation of the ossicles for attachment of the actuator 104. Specifically, the aperture 120 may be used to align a device for forming an interface on the ossicles for connection of the actuator 104. For instance, a laser drill or other instrumentation may be inserted through the aligned aperture to form an aperture in the ossicles that may be utilized to couple the actuator 104. In this case, the aperture 120 also provides a convenient conduit by which excess material from the operation may be removed from the patient. Still yet another advantage of the separate structure of the actuator 104 is that in the event a loading condition develops in the patient subsequent to implantation, e.g., due to events such as tissue growth and/or other changes in biological conditions, the actuator 104 may be separated from the transducer body 102 and the body 102 realigned in the proper position without disconnection of the actuator 104 from the ossicles. It should be noted that this would most likely require a small operation to access the implanted transducer 100, but the evasiveness of such a procedure is minimized as the interface between the actuator 104 and middle ear component is not disturbed.

Figure 2:
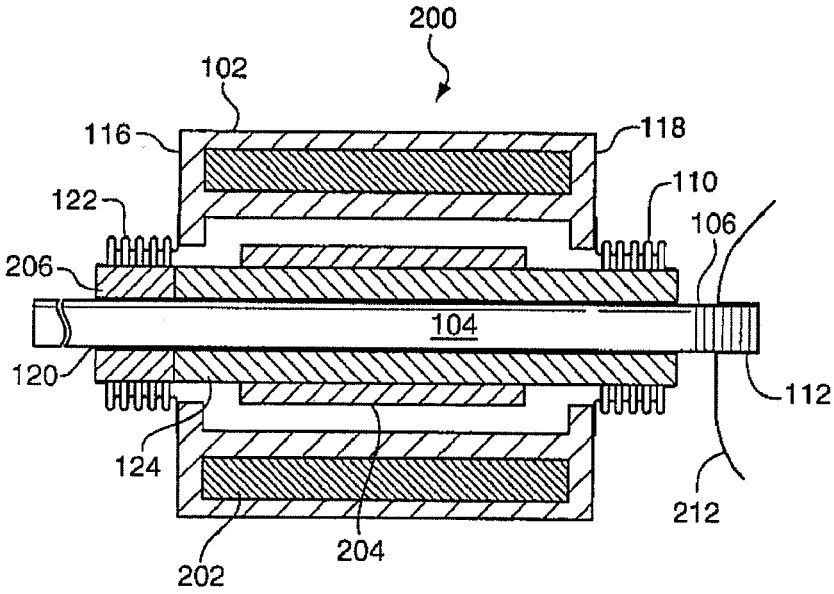
FIG. 2 illustrates another example of a transducer for a semi-implantable or fully implantable hearing aid device.

FIG. 2 illustrates an example of the transducer 100, namely transducer 200. The transducer 200 is an electromagnetic transducer that includes an electromagnetic driver having a coil 202 and magnet 204. The coil 202 may be electrically interconnected to a signal processor (not shown), which provides transducer drive signals that induce desired magnetic fields across the magnet 204, to affect a desired movement of the actuator 104. In this regard, the magnet 204 may be multiple magnets connected to the tube 124 or may be a single cylindrical magnet connected to and circumscribing the tube 124 as a matter of design choice.

The transducer 200 is substantially similar to the transducer 100 except that it includes an annular coupler 206 to connect the actuator 104 to the tube 124. The coupler 206 may be any apparatus suitable for providing a secure connection between the actuator 104 and the tube 124. Preferably, however, the coupler 206 forms a detachable connection therebetween as such a connection facilitates removal and/or adjustment of the transducer 200. According to this characterization, one example of the coupler 206 is a shape memory alloy including without limitation, NiTinol (trade name for the standard alloy Nickel-Titanium). Such alloys are known for their ability to take on a predetermined shape in response to a stimulus such as a temperature change. Specifically, shape memory alloys, such as NiTinol, undergo a phase transformation when cooled from their high temperature form, Austenite, to their low temperature form, Martensite. When such alloys are in the Martensite form, they are easily deformed to a new shape. When the alloy is heated, however, it recovers its previous shape, hence the name shape memory alloy. Advantageously, for alloys such as NiTinol, the temperature at which the alloy returns to its original shape may be adjusted, typically between the range of 100 degrees Celsius to negative 100 degrees Celsius.

In one example according to this characterization, the coupler 206 may be preformed (its original shape) in a connected state relative to the actuator 104. In other words, in its original shape, before a stimulus such as heat is applied, the actuator 104 is coupled within the tube 124. In this case, to achieve the connection with the ossicles, the coupler 206 may be heated so that the actuator 104 may be removed from the transducer body 102. The transducer body 102 may then be implanted within the mastoid process of the patient and the aperture 120 aligned with the ossicles, e.g., the incus 212. Subsequent to preparation of the incus, e.g., formation of a small interface or hole 112, the actuator 104 may be inserted through the aperture 120 and connected to the interface 112. Further alignment as necessary of the transducer body 102 may then be performed before the coupler 206 is returned to its original shape to couple the actuator 104 to the tube 124.

Figure 3:
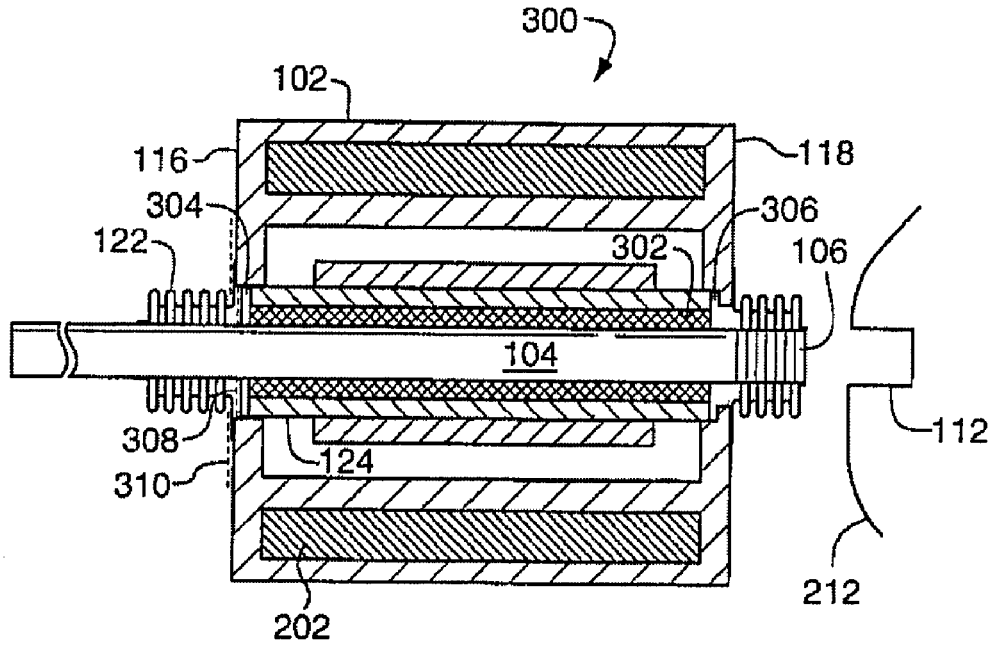
FIG. 3 illustrates another example of a transducer for a semi-implantable or fully implantable hearing aid device.

FIG. 3 illustrates another example of the transducer 100, namely transducer 300. Similar to the transducer 200, the transducer 300 is an electromagnetic transducer that includes an electromagnetic driver having a coil 202 and magnet 204. Also similar to the transducer 200, the transducer 300 includes the actuator 104 that is separately connectable to the transducer body 102 and the ossicles, e.g., the incus 212. In contrast, however, the transducer 300 includes a coupler 302 extending substantially along the length of aperture 120. In this case, the coupler 302 comprises a material that is reshapeable in situ at body temperature disposed within the tube 124 around the actuator 104. According to this characterization, the coupler 302 is configured to relax under light constant loading, to permit gradual axial movement of the actuator 104 relative to the tube 124. Such gradual movement of the actuator 104 relaxes load forces between the incuse 212 and actuator 104. For instance, such load forces may result from the natural movement of the ossicles during pressure changes because of a patient significantly changing altitudes, e.g., during a visit to the mountains or ride in an un-pressurized airplane.

In this regard, the coupler 302 should comprise a material viscous enough at body temperature, e.g., in the range of 94° to 108°, to be resistive to sudden movements, but also reshapeable in response to light constant loading to permit gradual displacement of the actuator 104 relative to the tube 124. This permits efficient mechanical energy transfer at audible frequencies, while allowing gradual load compensating displacements to occur. Although it will be appreciated that numerous materials (currently in existence and that will be available in the future) exhibiting the above-described properties may be utilized, some examples of the coupler 302 include without limitation, wax based materials, elastomer based materials, and/or silicon based materials. Those skilled in the art, however, will appreciate numerous other materials that may be utilized according to the principles of the present invention.

To maintain isolation of the internal components and prevent seepage of the coupler material 302, the ends of the tube 124 may include annular sleeves 304 and 306. In this regard, according to one example of the implantation procedure for the transducer 300, the sleeve 306 may be permanently connected, e.g., such as by welding, to the end of the tube 124. Alternatively, the end of the tube 124 may be of a stepped-in cylindrical configuration such that it forms an integral sleeve for containment of the coupler material 302. Subsequent to implanting and alignment of the transducer body 102 with the desired interface point 112, the actuator 104 may be inserted through the aperture 120 and connected to the incus 212. It should be noted, that at this point in the implant procedure, the bellows 122 is not connected to the transducer body 102. Further alignment of the transducer body 102 and actuator 104 may then be performed as necessary before the reshapeable material of the coupler 302 is injected around the actuator 104. Following introduction of the coupler material 302, the aperture 120 is sealed at the proximal end by the sleeve 304. In one example, of such a configuration, the sleeve 304 may be secured in place via an overlapping electrodeposited layer 308 (e.g., comprising a biocompatible material such as gold) disposed across and about the abutment region for interconnection and sealing purposes. Subsequent to securing the sleeve 304 in position on the tube 124, the bellows 122 is connected to the transducer body as illustrated in FIG. 3. According to this characterization, the bellows 122 may be connected by any appropriate means, with one example, including electrodeposited layer 310 disposed over the joint between the transducer body 102 and the bellows 122.

Figure 4:
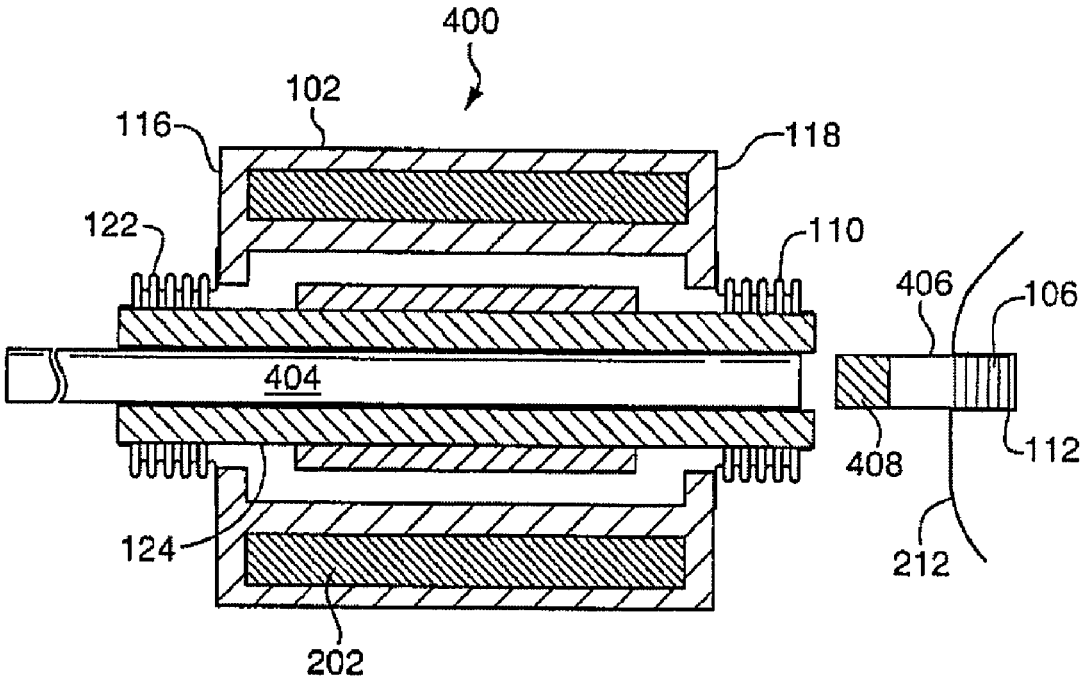
FIG. 4 illustrates another example of a transducer for a semi-implantable or fully implantable hearing aid device.

FIG. 4 illustrates another example of the transducer 100, namely the transducer 400. The transducer 400 is substantially similar to the transducers, 200 and 300, in that includes a transducer body 102 and an electromagnetic driver including the coil 202 and magnet 204. In contrast, however, the transducer 400 includes an actuator member comprising a first member 404 and a second member 406. As with the above embodiments, the members, 404 and 406, may be any structure of sufficient rigidity to transmit vibrations, with some examples including without limitation, a pin, a tube, a wire, etc. preferably formed from a biocompatible material such as, titanium, a titanium alloy, platinum, a platinum alloy, or gold-plated stainless steel.

The member 406 includes the distal end 106 made of, or coated with, a ceramic or other suitable material to facilitate coupling with the incus 212. The member 404, on the other hand, is an elongated member designed for coupling with the member 406. In this regard, at least one of the members, 404 and 406, in this case member 406, includes a coupling apparatus 408. The coupling apparatus 408 could be any mechanism capable of joining the members, 404 and 406, such that vibrations may be transmitted to the incus 212 from the transducer 400. In one preferred example of the transducer 400, the coupling apparatus 408 may comprise a shape memory alloy as described above. Advantageously, this permits the members, 404 and 406, to be easily separated without disturbing the connection between the interface 112 and member 406.

As with the transducers, 200 and 300, the actuator may be separately connected to the transducer 100 and the incus 212 during the implantation procedure. According to this characterization, the implantation procedure may involve connecting the member 406 to the incus 212. Advantageously, this may be performed prior to implanting and aligning the transducer body 102 or subsequent to implanting and aligning the transducer body 102 as a matter of choice. It should be noted, however, that each of these approaches provides its own advantages. For instance, where the member 406 is connected to the incus 212 prior to implantation of the transducer body 102 it will be appreciated that better visibility and spatial conditions exist for the surgeon or audiologist. Additionally, the member 406 may provide a target for alignment of the aperture 120 during the implantation. Alternatively, however, where the member 406 is connected to the incus 212 subsequent to implantation the transducer body 102, the transducer body 102 may be utilized to form an interface, e.g., 112 and align the member 406 with the interface 112 during connection.

In either case, subsequent to positioning of the transducer body 102, the member 404 may be inserted through the aperture 120 and coupled to the member 406. As with the above examples, the additional step of further aligning the transducer body 102 with the member 406 may precede the coupling step. Once the members, 404 and 406, are coupled, the member 404 may be connected within the tube 124 by either of the above-described methods, e.g., the coupler 302 or coupler 206. Alternatively, as with the above embodiments, any other suitable method, e.g., an adhesive or mechanical clamp, may also be utilized to make the connection as a matter of design choice.

Figure 5:
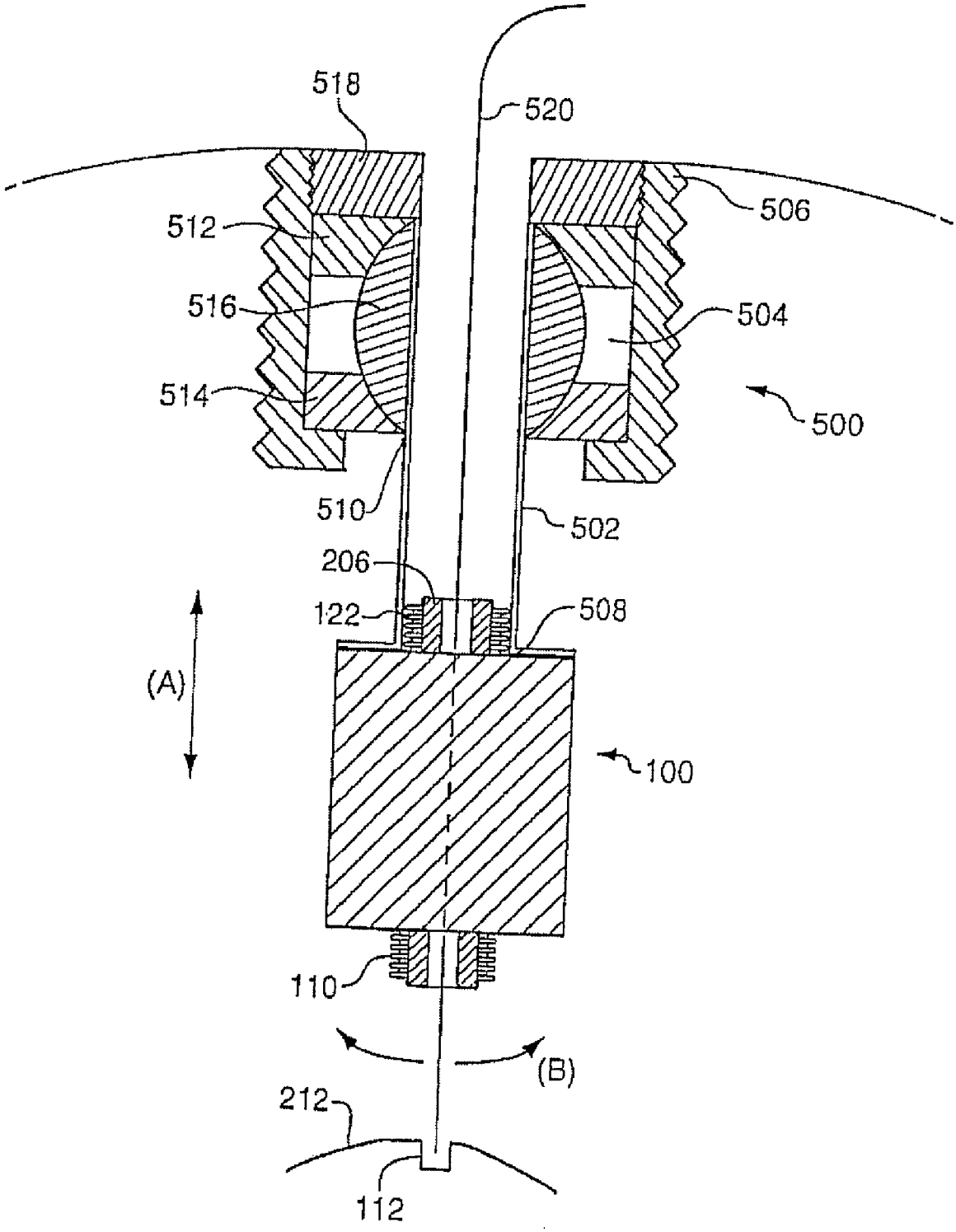
FIG. 5 illustrates an example of a positioning system and protocol for implantation of a transducer for a semi-implantable or fully implantable hearing aid device.

FIG. 5 illustrates an example of a transducer positioning system 500 that may be utilized to facilitate the implantation and alignment of the above-described transducers, e.g., 100. The positioning system 500 includes a carrier assembly 502, a swivel assembly 504, and a mounting apparatus 506, e.g., bone anchor. Such assemblies may be readily interconnected as illustrated on FIG. 5 to cooperate in a manner that allows for selective three-dimensional positioning of the transducer 100 at a desired location within the patient's skull.

In this regard, the transducer 100 is supportably connected to a first end 508 of the carrier assembly 502. In turn, the carrier assembly 502 is supportably received in an opening 510 provided in the swivel assembly 504. The assembled carrier assembly 502 and swivel assembly 504 is supportably interconnected to the mounting apparatus 506. Swivel assembly 504 includes opposing, top and bottom plate members 512 and 514, respectively, which are interconnected to capture a rotatable ball member 516 therebetween. The rotatable ball member 516 also includes an aperture defining a portion of the opening 510 for receiving the carrier assembly 502.

As will be appreciated, when carrier assembly 502 is positioned through opening 510, the carrier assembly 502 is movable in a first dimension, e.g., axially or vertically in the direction (A) relative to the incus 212 to position the transducer 100 proximate the incus 212. Similarly, when carrier assembly 502 is initially positioned through opening 510, the ball member 516 is loosely constrained between the top and bottom plates, 512 and 514, to permit lateral positioning along arc (B) of the transducer 100. Specifically the axial and lateral alignment of the transducer 100 is to achieve alignment of the aperture 120 with a desired interface point, e.g., for the formation of an interface, such as 112, on the incus 212. In other words, the tube 124 may be utilized during positioning of the transducer 100 to align the transducer 100 with the desired interface point, as well as to provide the positional relationship between the actuator 104 and transducer body 102 when the actuator 104 is inserted therein. During such positioning, it may also be desirable to utilize a guide such as guide 520, inserted through the aperture 120 to precisely locate the desired interface point on the incus 212.

Once the transducer body 102 is positioned, e.g., alignment of the aperture 120 with the interface point, a locking nut 518 is rotatably securable within the mounting apparatus 506 to secure the ball member 516, which in turn secures the carrier assembly 502 and fixes the position of the transducer body 102. Once the transducer body 102 is positioned, the aperture 120 may again be utilized as a guide for a drill or other instrument for forming the interface 112 on the incus 212. Advantageously, according to this characterization, the tube 124 is further utilized to form the interface 112 in the incus 212, as well as to locate the desired interface point, and position the transducer body 102 relative to the interface point.

Figure 6:
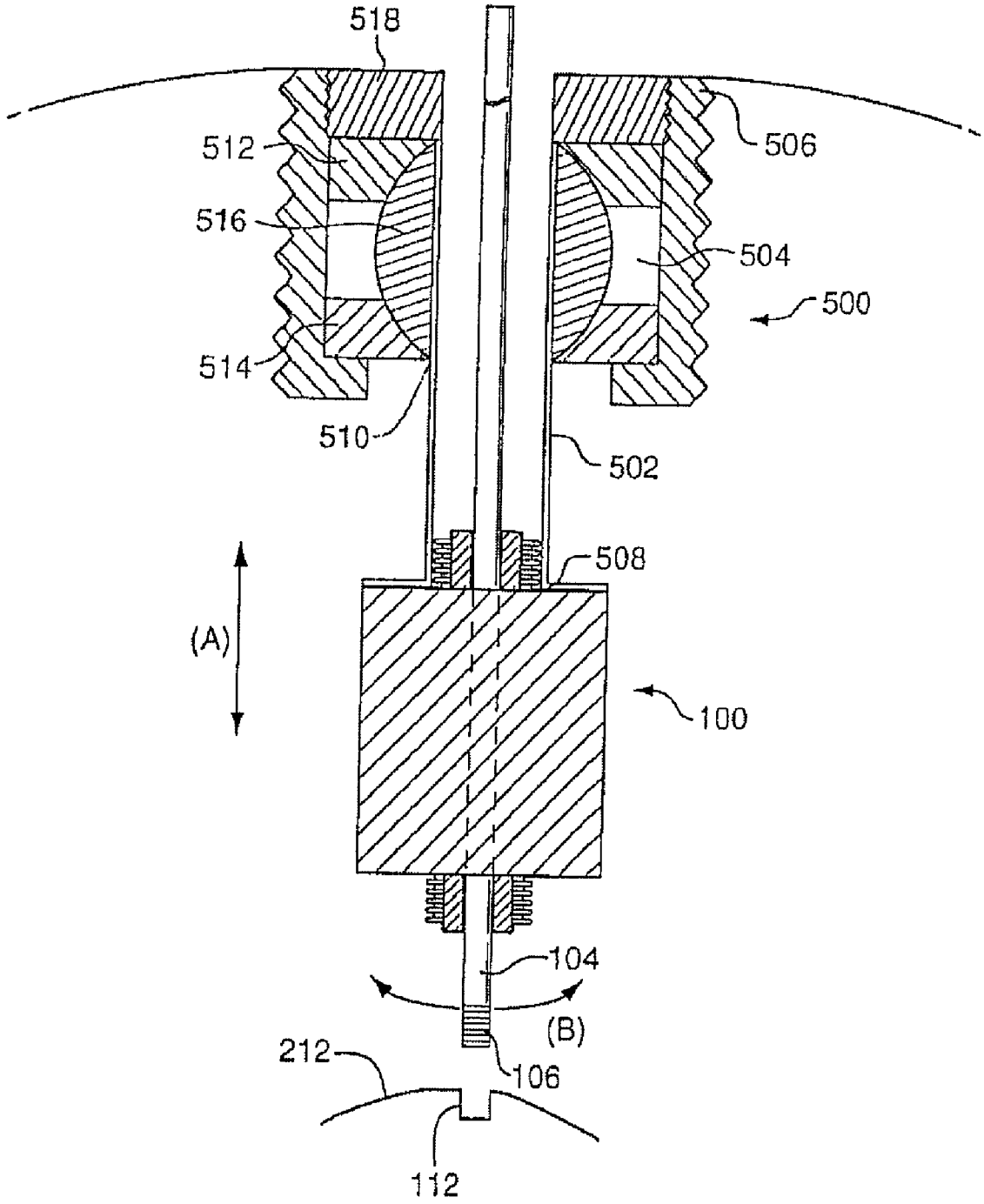
FIG. 6 further illustrates the positioning system and protocol for implantation a transducer for a semi-implantable or fully implantable hearing aid device.

Referring to FIG. 6, subsequent to preparation of the incus 212, the actuator 104 is inserted through the positioning system 500 and the aperture 120 where it is connected to the interface 112 in a conventional manner. It should be noted in this regard, that substantially no load is applied on the incus 212 during the connection, as the weight of the actuator 104 is substantially inconsequential. Additionally, connection of the actuator 104 is simplified as the surgeon or audiologist is able to sense or feel when the actuator 104 is completely seated within the interface 112. Furthermore, when pressure applied during connection of the actuator 104 is released, the incus 212 is able to compensate for loading through movement of the actuator 104 to an equilibrium position prior to connection of the actuator 104 to the transducer body 102. Subsequent to connecting the actuator 104 to the incus 212, the locking nut 518 may again be loosened to permit further alignment of the transducer 100 relative to the connected actuator 104 as necessary. When final positioning of the transducer 100 is achieved, the actuator 104 is coupled within the tube 124 to complete the implantation process.

It should be noted that the above-described operation would be similar with regard to the transducer 400 except that the operation would require the additional step of connecting the actuator members, 404 and 406, prior to connection of the member 404 to the transducer body 102.

Figure 7:
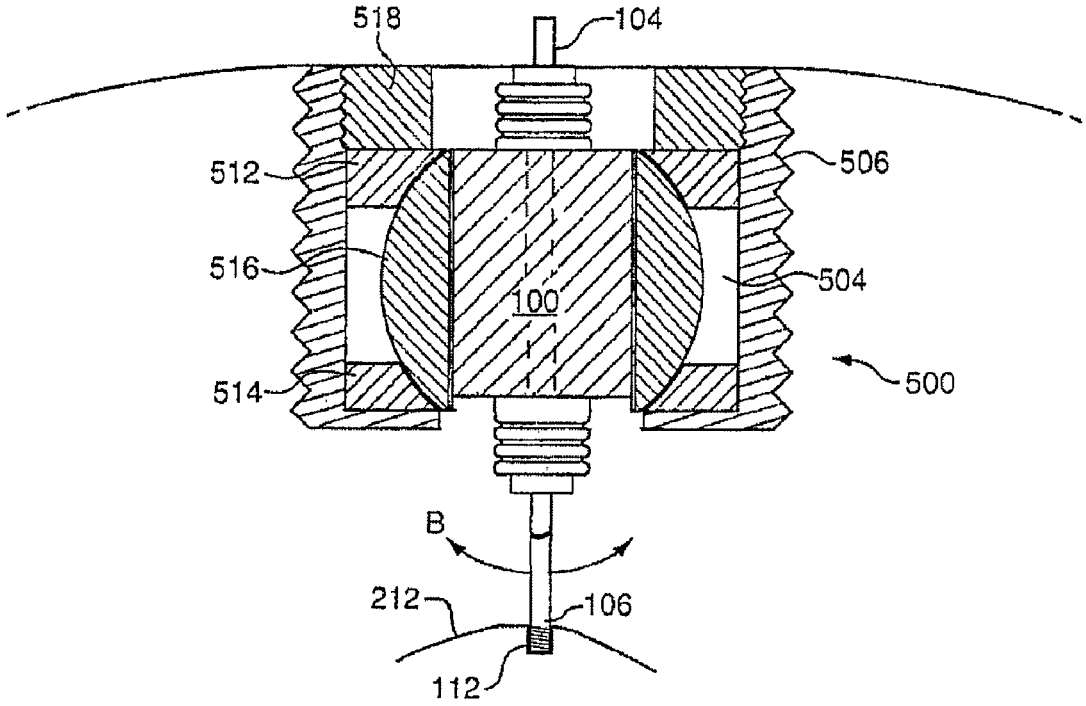
FIG. 7 illustrates another example of a transducer for a semi-implantable or fully implantable hearing aid device.

FIG. 7 illustrates another example of a method for implanting a transducer, such as transducer 100, within a patient. In this case, however, the transducer 100 and positioning system 500 are configured such that the transducer 100 may be positionally retained within the ball member 516. This in turn permits lateral alignment of the aperture 120, along arc B, with a desired interface point on the incus 212. As with the above embodiment, the transducer 100 may initially be loosely constrained within the positioning system 500 and a guide such as a laser sight utilized to align the aperture 120 with the interface point on the incus 212.

Once the transducer 100 is laterally positioned, the locking nut 518 may be utilized to secure the ball member 516 around the transducer 100, which in turn secures the transducer 100 in a fixed position relative to the positioning system 500. It will also be appreciated that as with the above embodiment, the aperture 120 may be utilized, following the positioning, as a guide for a drill or other instrument to form the interface 112 on the incus 212. Once positioned, the actuator 104 may be inserted through the aperture 120 and connected to the incus 212 and transducer 100 as described above.

According to the present example, the length of the actuator 104 controls the vertical relationship between the transducer 100 and incus 212. Thus, it may be desirable to utilize actuator members of various lengths as the exact distance between the mounted transducer 100 and the interface 112 may vary slightly from patient to patient. Alternatively, however, a sufficiently long actuator may be utilized and the excess length trimmed substantially flush with the top of the transducer 100 following connection with the incus 212 and transducer body 102.

Advantageously, this method provides a simple means of implanting and positioning the transducer 100 within a patient. Furthermore, it will be appreciated that the present method eliminates the use of the carrier assembly 502, as the length of the actuator 104 may be varied to achieve the vertical relationship between the transducer 100 and incus 212. This in turn simplifies implantation and positioning as well as reducing foreign objects introduced to the patient.

Figure 8:
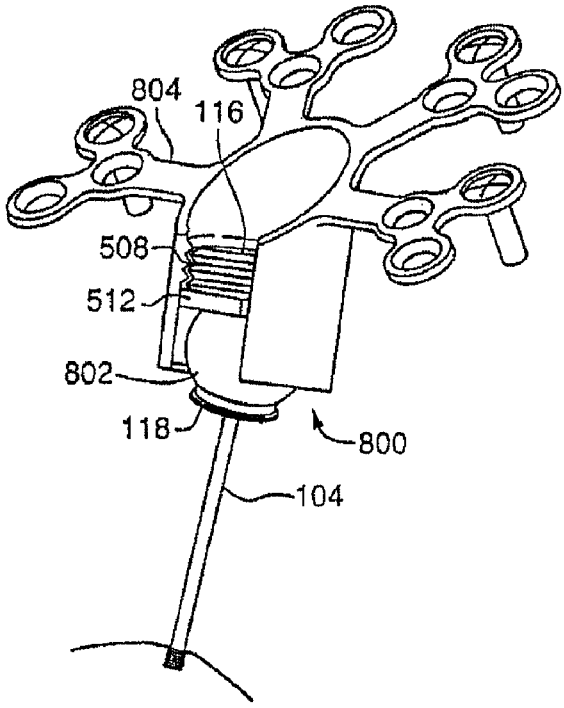
FIG. 8 illustrates another example of a transducer for a semi-implantable or fully implantable hearing aid device.
Figure 9A:
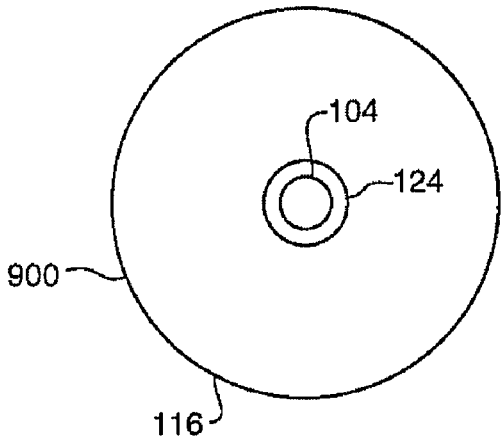
FIGS. 9*a* and 9*b* illustrate and bottom view of the transducer of FIG. 8 for a semi-implantable or fully implantable hearing aid device.
Figure 9B:
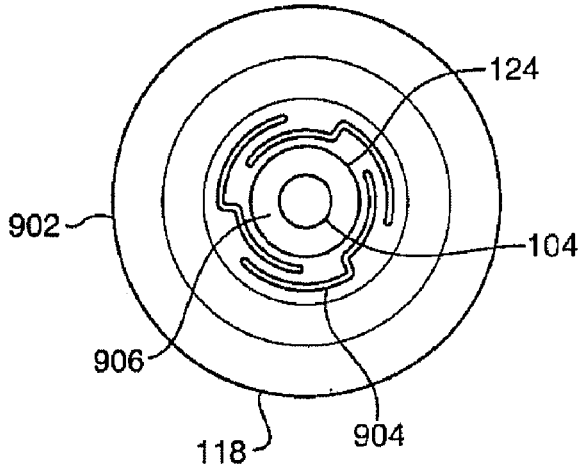

FIGS. 8 and 9 illustrate another example of a transducer 100 according to the present invention, namely transducer 800. Similar to transducer 100, the transducer 800 includes a driver, e.g., coil 202 and magnet 204, which drives an internally mounted tube 124 to transmit vibrational energy to the actuator 104. In contrast, however, the transducer body 802 is configured in the shape of the ball member 516. In other words, the transducer body 802 is configured for rotational movement within a mounting apparatus, e.g., bone anchor 804, to align the transducer 800 for connection with the incus 212. Specifically, the transducer body 802 replaces the ball member 516 of the positioning system 500, such that the aperture 120 is aligned with the incus 212 through rotational movements of the transducer body 802 within the bone anchor 804. Once properly aligned, the locking nut 518 is tightened down to secure the transducer between the top plate 512 and a bottom lip 806 of the bone anchor 804.

As with the above embodiment, the length of the actuator 104 controls the vertical relationship between the transducer 800 and incus 212. Thus, it may be desirable to utilize actuator members of various lengths as the exact distance between the mounted transducer 800 and the interface 112 may vary slightly from patient to patient. Alternatively, however, a sufficiently long actuator may be utilized and the excess length trimmed substantially flush with the top 116 of the transducer 800 following connection with the incus 212 and transducer body 802.

It will also be appreciated that the transducer 800 does not include the bellows members 110 and 122. Rather, the tube 124 of the transducer 100 may be movably connected in a substantially flush relation to the ends 116 and 118 of the transducer 800. According to this characterization, the tube 124 may be connected to the transducer body 802 using a spring washer 902 fixed to the end 118 such as by welding or electrodeposition. Tube 124 may connect to spring washer 902 by any suitable means, with one example including flange 906. Flange 906 sandwiches spring washer 902 between the flange 906 and the end of the tube 124.

To permit movement of the tube 124 relative to the transducer body 802, the spring washer 902 includes helical compression leafs 904. At its opposing end 116, however, the tube 124 may be slidably engaged within an aperture formed in the top 900 of the transducer body 802 such that the tube 124 is axially movable therein relative to the transducer 800. Alternatively, a second spring washer 902 may be utilized to connect the tube 124 to the top of the transducer body 802. It will be appreciated that according to this characterization, spring washer 902 and top 900 may not provide a sealing function at the ends 116 and 118 of the transducer 800. Accordingly, it may be desirable to seal the magnet 204 to the tube 124 during construction of the transducer 800. For instance, the magnet 204 may be sealed using plating, such as gold or titanium, or may even be coated with other materials, preferably biocompatible, to protect the magnet during the introduction of bodily fluids within the interior of the transducer body 802.

Figure 10:
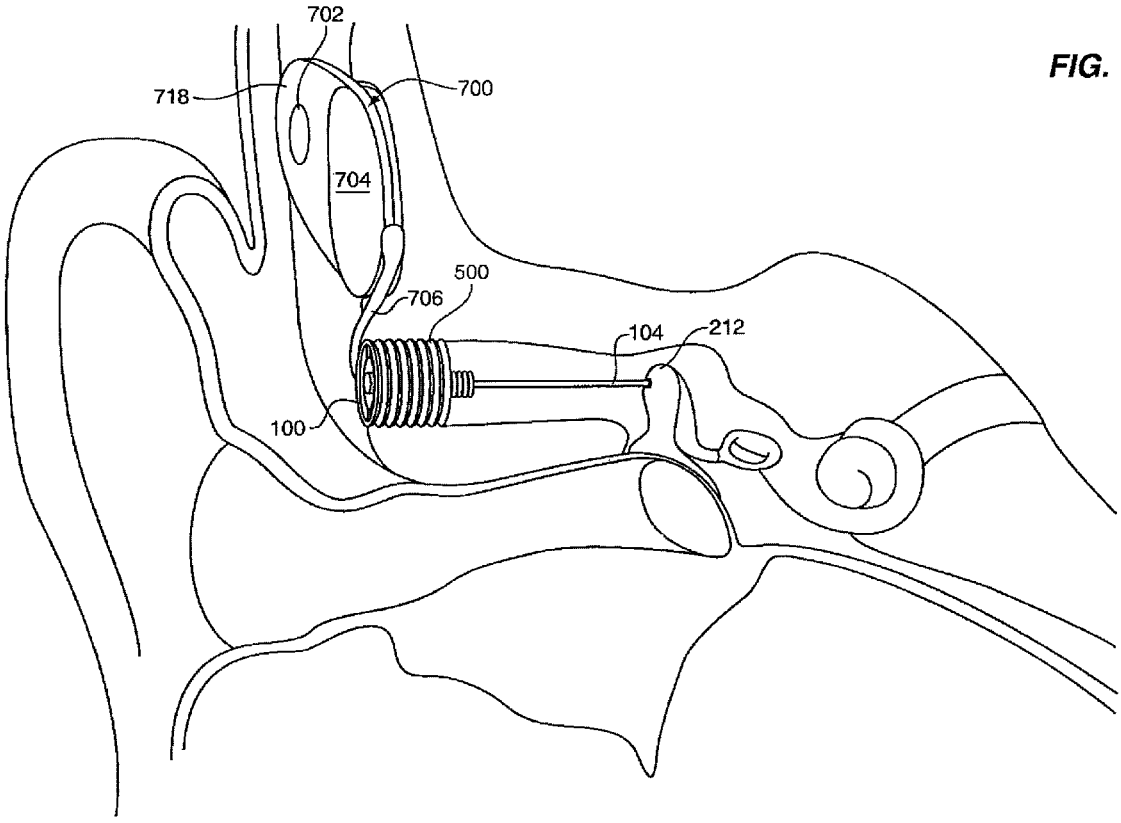
FIGS. 10 and 11 illustrate implantable and external componentry respectively, of a semi-implantable hearing aid device application of the present invention.
Figure 11:
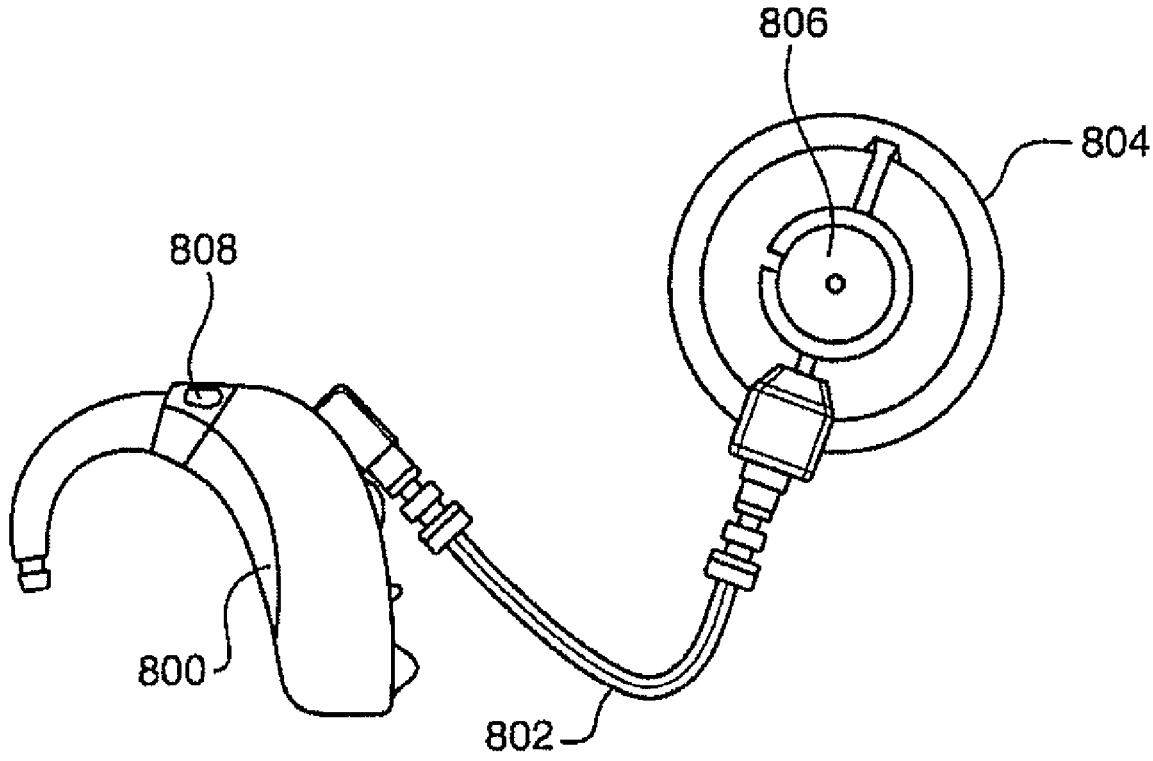

FIGS. 10 and 11 illustrate one application of the present invention in a semi-implantable hearing aid device. The illustrated application comprises a semi-implantable hearing aid device having implanted components shown in FIG. 10, and external components shown in FIG. 11. As will be appreciated, the present invention may also be employed in conjunction with fully implantable systems, wherein all components of a hearing aid system are located subcutaneously.

In the illustrated device, an implanted biocompatible housing 700 is located subcutaneously on the patient's skull. The housing 700 includes an RF signal receiver 718 (e.g., comprising a coil element) and a signal processor 704 (e.g., comprising processing circuitry and/or a microprocessor). The signal processor 704 is electrically interconnected via wire 706 to the transducer 100. As will be appreciated various processing logic and/or circuitry may also be included in the housing 700 as a matter of design choice.

The transducer 100 is supportably connected to the transducer positioning system 500 which in turn, is mounted within the patient's mastoid process (e.g., via a hole drilled through the skull). Referring to FIG. 11, the semi-implantable system further includes an external housing 800 comprising a microphone 808 and internal speech signal processing (SSP) circuitry (not shown). The SSP unit is electrically interconnected via wire 802 to an RF signal transmitter 804 (e.g., comprising a coil element). The external housing 800 is configured for disposition around the rearward aspect of the patient's ear. The external transmitter 804 and implanted receiver 718 each include magnets, 806 and 702 respectively, to facilitate retentive juxtaposed positioning.

During normal operation, acoustic signals are received at the microphone 808 and processed by the SSP unit within external housing 800. As will be appreciated, the SSP unit may utilize digital processing to provide frequency shaping, amplification, compression, and other signal conditioning, including conditioning based on patient-specific fitting parameters. In turn, the SSP unit via wire 802 provides RF signals to the transmitter 804. Such RF signals may comprise carrier and processed acoustic drive signal portions. The RF signals are transcutaneously transmitted by the external transmitter 804 to the implanted receiver 718. As noted, the external transmitter 804 and implanted receiver 718 may each comprise coils for inductive coupling signals therebetween.

Upon receipt of the RF signal, the implanted signal processor 704 processes the signals (e.g., via envelope detection circuitry) to provide a processed drive signal via wire 706 to the transducer 100. The drive signals cause the actuator 104 to axially vibrate at acoustic frequencies to effect the desired sound sensation via mechanical stimulation of the ossicles of the patient. More particularly, the modulating drive signals yield a changing magnetic field at transducer 100, thereby effecting movement of the actuator 104.

Those skilled in the art will appreciate variations of the above-described embodiments that fall within the scope of the invention. As a result, the invention is not limited to the specific examples and illustrations discussed above, but only by the following claims and their equivalents.

We claim:

1. A method for implanting a hearing aid transducer within a patient, the method comprising the steps of:

mounting a transducer body subcutaneously within the patient;

aligning an aperture in a first side of the transducer body with a desired interface point on a middle ear component;

securing the transducer body in the aligned position relative to the desired interface point; and manually advancing an actuator through the aperture toward the middle ear component independent from operation of the hearing aid transducer after securing the transducer body.

2. The method of claim 1, wherein the aperture extends through a second side of the transducer body.

3. The method of claim 2, the method comprising:
prior to the advancing step, inserting the actuator into the aperture.

4. The method of claim 1, the method comprising:
coupling a distal end of the actuator to the middle ear component.

5. A method for implanting a hearing aid transducer within a patient, the method comprising the steps of:
mounting a transducer body subcutaneously within the patient;
aligning an aperture in a first side of the transducer body with a desired interface point on a middle ear component by axially advancing the transducer body relative to the desired interface point using a carrier assembly, and laterally positioning the transducer body relative to the desired interface point using a swivel assembly;
securing the transducer body in the aligned position relative to the desired interface point;
advancing an actuator through the aperture toward the middle ear component; and,
coupling a distal end of the actuator to the middle ear component.

6. A method for implanting a hearing aid transducer within a patient, the method comprising the steps of:
mounting a transducer body subcutaneously within the patient;
aligning an aperture in a first side of the transducer body with a desired interface point on a middle ear component by inserting a guide through the aperture, and aligning the aperture with the desired interface point on the middle ear component using the guide;
securing the transducer body in the aligned position relative to the desired interface point;
advancing an actuator through the aperture toward the middle ear component; and,
coupling a distal end of the actuator to the middle ear component.

7. A method for implanting a hearing aid transducer within a patient, the method comprising the steps of:
mounting a transducer body subcutaneously within the patient;
aligning an aperture in a first side of the transducer body with a desired interface point on a middle ear component;
securing the transducer body in the aligned position relative to the desired interface point;
advancing an actuator through the aperture toward the middle ear component; and,
coupling a distal end of the actuator to the middle ear component by coupling a first actuator member to the middle ear component, advancing a second actuator member through the aperture, and connecting the first and second actuator members.

8. A method for implanting a hearing aid transducer within a patient, the method comprising the steps of:
mounting a transducer body subcutaneously within the patient;
aligning an aperture in a first side of the transducer body with a desired interface point on a middle ear component;
securing the transducer body in the aligned position relative to the desired interface point;
advancing an actuator through the aperture toward the middle ear component;
coupling a distal end of the actuator to the middle ear component; and,
connecting the actuator to the transducer body within the aperture.

9. The method of claim 8, wherein the connecting step comprises:
connecting the actuator to the transducer body within the aperture in a detachable manner.

10. The method of claim 8, wherein the connecting step comprises:
connecting the actuator to the transducer body within the aperture with an adhesive.

11. The method of claim 8, wherein the connecting step comprises:
connecting the actuator to the transducer body within the aperture with a shape memory metal.

12. The method of claim 8, wherein the connecting step comprises:
connecting the actuator to the transducer body within the aperture with a reshapeable material.

13. A method for implanting a hearing aid transducer within a patient, the method comprising the steps of:
mounting a transducer body subcutaneously within the patient;
aligning an aperture extending through first and second sides of the transducer body with a desired interface point on a middle ear component; and
securing the transducer body in the aligned position relative to the desired interface point; and
inserting an actuator through the aperture, wherein a proximal end of the actuator is accessible for advancement relative to the transducer body to couple a distal end of the actuator with the middle ear component.

14. The method of claim 13, the method comprising:
coupling the actuator to the middle ear component.

15. The method of claim 13, wherein the inserting step comprises:
inserting the actuator through a tube extending through the aperture.

16. The method of claim 15 the method comprising:
connecting the actuator to the tube.

17. The method of claim 13, wherein the aligning step comprises:
inserting a guide through the aperture; and
aligning the aperture and the desired interface point on the middle ear component using the guide.

18. A method for operating an implantable transducer, the method comprising the steps of:
receiving transducer drive signals in the transducer;
processing the drive signals to axially vibrate a tube movably connected within an aperture defined in the transducer between first and second sides thereof; and
axially vibrating, with the tube, an actuator connected to the tube to stimulate a middle ear component.

19. The method of claim 8, wherein the aperture extends through a second side of the transducer body, and wherein a proximal end of the actuator is accessible for advancement relative to the transducer body to couple a distal end of the actuator with the middle ear component.

20. A method for implanting a hearing aid transducer within a patient, the method comprising the steps of:
mounting a transducer body subcutaneously within the patient;
aligning an aperture in a first side of the transducer body with a desired interface point on a middle ear component, wherein the aperture extends through a second side of the transducer body;
securing the transducer body in the aligned position relative to the desired interface point;
using the aligned aperture to form an interface at the desired interface point on the middle ear component; and
advancing an actuator through the aperture toward the middle ear component after the using step.

* * * * *